US006848982B2

(12) United States Patent
Caporusso

(10) Patent No.: US 6,848,982 B2
(45) Date of Patent: Feb. 1, 2005

(54) TUBULAR WORKPIECE NOTCHING MACHINE USABLE FOR GENERAL GRINDING OPERATIONS

(75) Inventor: Alessandro Caporusso, Piedimonte San Germano (IT)

(73) Assignee: New Tech S.r.l., Piedimonte San Germano (IT)

( * ) Notice: Subject to any disclaimer, the term of this patent is extended or adjusted under 35 U.S.C. 154(b) by 0 days.

(21) Appl. No.: 10/293,345

(22) Filed: Nov. 14, 2002

(65) Prior Publication Data

US 2003/0092366 A1 May 15, 2003

(30) Foreign Application Priority Data

Nov. 15, 2001 (IT) ..... RM2001A0677

(51) Int. Cl.[7] ..... B24B 21/00

(52) U.S. Cl. ..... 451/311; 451/296; 451/414; 269/71; 76/42

(58) Field of Search ..... 451/311, 414, 451/296; 269/60, 71; 76/42

(56) References Cited

U.S. PATENT DOCUMENTS 5,142,947 A * 9/1992 Wang ..... 76/42
5,357,714 A 10/1994 Landhuis
5,437,570 A 8/1995 Landhuis
5,630,757 A 5/1997 Gagin et al.

FOREIGN PATENT DOCUMENTS

| | | |
|---|---|---|
| DE | 295 04 077 | 4/1995 |
| DE | 299 04 027 | 5/1999 |
| GB | 2 262 462 A | 6/1993 |

* cited by examiner

*Primary Examiner*—George Nguyen
(74) *Attorney, Agent, or Firm*—Young & Thompson

(57) ABSTRACT

A tubular workpiece notching machine usable for general grinding operations has a worktable (1) whose base plate (10) is pivotally mounted to the frame (6) of the notching machine around a pivotal orthogonal axis (Y—Y) in such a manner that the worktable (1) is movable from a first working position in which the machine vice (2) co-operates with the shaping pulley (3) in recessing ends of tubular workpiece by grinding, to a second working position in which the shaping pulley (3) is used for generally grinding a workpiece. Connecting elements are provided for removably anchoring the base plate (10) of the worktable (1) to the frame (6) in the first working position.

5 Claims, 1 Drawing Sheet

TUBULAR WORKPIECE NOTCHING MACHINE USABLE FOR GENERAL GRINDING OPERATIONS

TECHNICAL FIELD

This invention relates to a tubular workpiece notching machine usable for general grinding operations. The term "grinding operation" means any operation which is performed by removing chips from a workpiece by means of an abrasive belt.

The so called notching machine is a grinding machine for shaping or recessing the ends of tubular workpieces. This machine has a pair of pulleys carrying on an abrasive belt: one of the pulleys is a driving pulley for the abrasive belt and the other pulley is a shaping pulley co-operating with the abrasive belt to shape recesses. A machine vice for clamping a tubular workpiece is located near the shaping pulley and is movable towards and away from the shaping pulley in order to allow the tubular workpiece, clamped by the machine vice, to be ground.

BACKGROUND OF THE INVENTION

In prior art notching machines, in order to achieve a movement of the machine vice towards and away from the shaping pulley, the machine vice is mounted so to rotate on a worktable as well known. The worktable has a feeding movement with respect to the shaping pulley, that is performed by known feeding means and controlled by control means, that are known as well.

Nowadays notching machines are not able to operate as simple grinding machines because the worktable itself prevents an operator from bringing workpieces to be ground near the shaping pulley. Therefore, today two different machines are required in order to perform either grinding and notching operations. This causes large capital requirements with a consequence of an increase of production costs, as well as a great encumbrance in a plant.

This invention seeks to overcome the drawbacks above mentioned.

In particular, an object of the present invention is to manufacture a machine which allows both tubular workpieces notching and general grinding operations to be performed.

DISCLOSURE OF THE INVENTION

Therefore, according to the present invention this object is achieved by a tubular workpiece notching machine usable for general grinding operations, having on a frame a pair of pulleys carrying an abrasive belt travelling endlessly on them, and a worktable holding up, over a base plate, a machine vice adjustable in its angular position with respect to a shaping pulley of said pair of pulleys, wherein said base plate of the worktable is pivotally mounted in said frame around a pivotal orthogonal axis in such a manner that the worktable is movable, by rotation around said pivotal axis, from a first working position in which the machine vice co-operates with said shaping pulley in recessing ends of tubular workpiece by grinding, to a second working position in which the shaping pulley is used for generally grinding a workpiece; connecting means being provided for removably anchoring said base plate of the worktable to the frame in said first working position.

Figure 2:
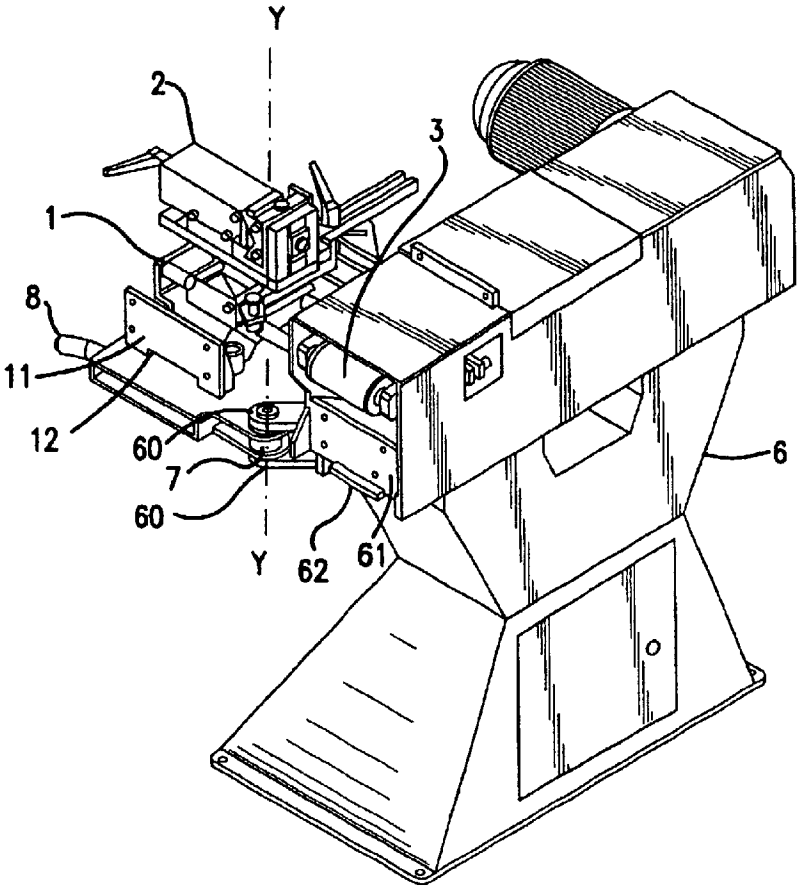
Figure 1:
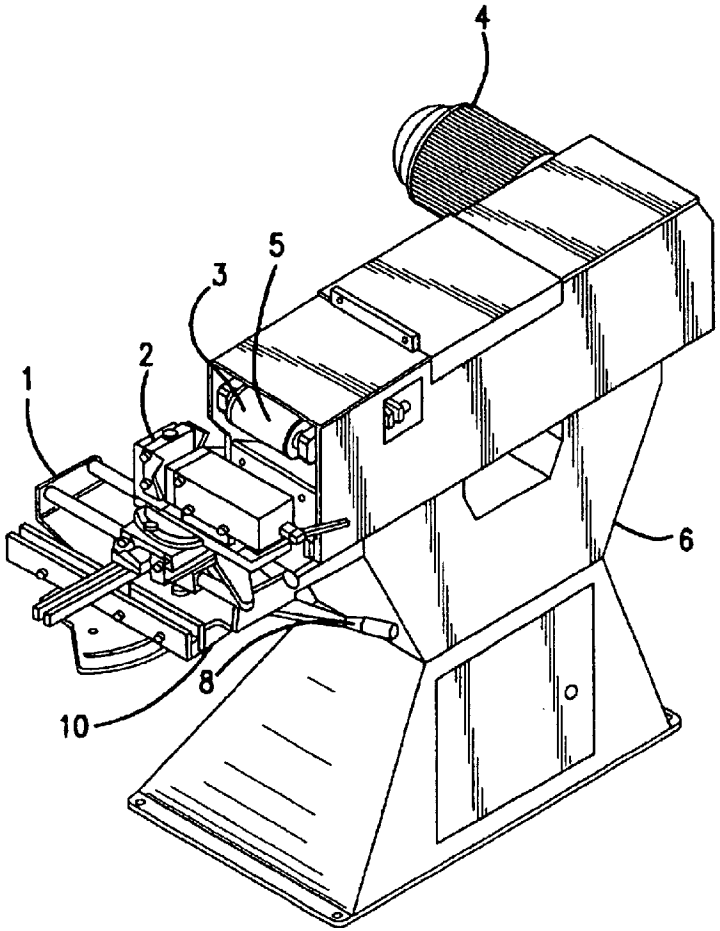

The invention will be described below with reference to an embodiment thereof in connection with the accompanying drawing, in which;

FIG. 1 is a perspective view of a notching machine according to the present invention in a working position for recessing ends of tubular workpieces; and FIG. 2 is a perspective view of a notching machine in FIG. 1 in a working position for general grinding operations.

In the figures a notching machine pulley according to the present invention is shown. First, reference is made to FIG. 1, in which a worktable 1 holds up, over a base plate 10, a machine vice 2 adjustable in its angular position with respect to a shaping pulley 3. The shaping pulley 3 is the one pulley of a pair of pulleys, the other pulley, not shown in the drawing, being a driving pulley connected to a motor 4. An abrasive belt 5 travels endlessly on the two pulleys.

The specific worktable 1, shown in the figures, is disclosed in another patent application of the same Applicant. This worktable 1 is provided with a single hand control member 8 for moving the machine vice 2 towards and away from the shaping pulley 3.

Anyway, it should be apparent that the worktable could be different, e.g. of a conventional type. As known, the worktable allows the workpiece clamped by the machine vice 2 to be moved according to a desired orientation angle with respect to the shaping pulley 3.

Unusually the base plate 10 of the worktable 1 is not integral with a frame 6 if the notching machine. According to the present invention, as shown in FIG. 2, the base plate 10 is pivotally mounted in the frame 6 around a pivotal orthogonal axis Y—Y.

In particular, in the depicted embodiment, the pivotal axis Y—Y of the base plate 10 in the frame 6 is made by a couple of lugs 60, 60 integral with the frame 6, that pivotally hold internally the base plate 10 through a rotational pivot 7. Obviously, the pivotal axis can be made differently.

In this way the worktable 1 is movable, by rotation around the pivotal axis Y—Y, from a first working position shown in FIG. 1 to a second working position shown in FIG. 2. In the first working position the machine to vice 2 co-operates with the shaping pulley 3 in recessing ends of tubular workpiece (not shown) by grinding, and in the second working position the shaping pulley 3 can be used for generally grinding a workpiece. In this second working position the worktable can be suitable joined to the frame of the machine.

Even if not shown in FIG. 2, the frame 6 can be provided with useful fittings, for example a balancing platform, for grinding operations. For this purpose a front plate 61, being integral with the frame 6, can be used. The front plate 61 operates as an abutting vertical plate for connecting means adapted to removably anchor the base plate 10 of the worktable 1 to the frame 6 in the first working position.

Such connecting means comprise, in addition to the vertical plate 61, a connecting counter-plate 11, which is connected at right angles to the base plate 10. Threaded coupling means, not shown, connect the vertical abutting plate 61 to the connecting counter-plate 11, when the worktable is rotated from the second working position to the first one.

Further, the connecting means have male-female type, mutually matching means. For example such matching means are made by a list 62 integral in a lower part of the abutting vertical plate 61 and a corresponding slot 12 in the connecting counter-plate 11.

The present invention has been described with reference to its specific embodiment, but it would be expressly understood that modifications, addition and/or omissions can be made without departing from the spirit of invention as defined in the enclosed claims.

What is claimed is:

1. A tubular workpiece notching machine usable for general grinding operations, having on a frame (6) a pair of pulleys carrying an abrasive belt (5) travelling endlessly on them, and a worktable (1) holding up, over a base plate (10), a machine vice (2) adjustable in its angular position with respect to a shaping pulley (3) of said pair of pulleys, characterized in that:

said base plate (10) of the worktable (1) is pivotally mounted in said frame (6) around a pivotal orthogonal axis (Y—Y) in such a manner that the worktable (1) is movable, by rotation around said pivotal axis, from a first working position in which the machine vice (2) co-operates with said shaping pulley (3) in recessing ends of tubular workpiece by grinding, to a second working position in which the shaping pulley (3) is used for generally grinding a workpiece;

connecting means are provided for removably anchoring said base plate (10) of the worktable (1) to the frame (6) in said first working position.

2. The tubular workpiece notching machine according to claim 1, characterized in that said pivotal axis (Y—Y) of the base plate (10) in the frame (6) is made by a couple of lugs (60, 60) integral with the frame (6), that pivotally hold internally said base plate (10) through a rotational pivot (7).

3. The tubular workpiece notching machine according to claim 1, characterized in that said connecting means for removably anchoring said base plate (10) of the worktable (1) to the frame (6) in said first working position comprise an abutting vertical plate (61) integral with the frame (6), a connecting counter-plate (11), which is connected at right angles to the base plate (10) and designed to match frontally with said abutting vertical plate (61) in said second working position, and threaded coupling means to connect the abutting vertical plate (61) to the connecting counter-plate (11).

4. The tubular workpiece notching machine according to claim 3, characterized in that said connecting means have male-female type, mutually matching means (62, 12).

5. The tubular workpiece notching machine according to claim 1, characterized in that said worktable is provided with a single hand control member (8) for moving the machine vice (2) towards and away from the shaping pulley (3) in said first working position.

* * * * *